US007581505B2

(12) United States Patent
I'Abee et al.

(10) Patent No.: US 7,581,505 B2
(45) Date of Patent: Sep. 1, 2009

(54) METHOD FOR CAULKING THE DECK OF SHIPS

(76) Inventors: Marcel I'Abee, Rijsenborch 197, 4132 HM Vianen (NL); Petrus Johannes Cornelius Vosters, Tempeliersdal 21, 5076CK Haaren (NL); Petrus Wilhelmus Johannes Van Beers, Lijsterboorg 24, 5081 RM Hilvarenbeek (NL)

( * ) Notice: Subject to any disclaimer, the term of this patent is extended or adjusted under 35 U.S.C. 154(b) by 527 days.

(21) Appl. No.: 11/274,892

(22) Filed: Nov. 16, 2005

(65) Prior Publication Data

US 2006/0155049 A1 Jul. 13, 2006

(30) Foreign Application Priority Data

Nov. 16, 2004 (EP) ..... 04078140

(51) Int. Cl.
*B63B 5/02* (2006.01)

(52) U.S. Cl. ..... 114/85; 114/86; 525/100; 525/101; 525/104; 525/106; 525/342; 106/287.1; 106/287.12; 106/287.16

(58) Field of Classification Search ..... 114/85, 114/86; 525/100, 101, 104, 106, 342; 106/287.1, 106/287.12, 287.16
See application file for complete search history.

(56) References Cited

U.S. PATENT DOCUMENTS

| | | | | |
|---|---|---|---|---|
| 3,863,417 | A | 2/1975 | Franchi et al. | |
| 4,382,999 | A | 5/1983 | Harima et al. | |
| 5,026,812 | A * | 6/1991 | Geilich | 528/17 |
| 5,705,561 | A | 1/1998 | Kozakiewicz et al. | |
| 6,552,118 | B2 * | 4/2003 | Fujita et al. | 524/588 |
| 2002/0156174 | A1 * | 10/2002 | Mafoti et al. | 524/492 |

FOREIGN PATENT DOCUMENTS

| | | |
|---|---|---|
| EP | 0 789 036 | 8/1997 |
| EP | 1 153 942 | 11/2001 |
| EP | 1 598 402 | 11/2005 |
| GB | 532470 | 1/1941 |

OTHER PUBLICATIONS

Kusakabe, M., et al., "Review of Innovative Developments of Silyl-Modified Polymers for Sealant, Adhesive and Coating Applications", European Coatings, pp. 43-50 (Dec. 2005) Kaneka, Belgium.

Unknown, "Technical Information for Merz + Benteli—1. Deck Caulking with A Standard MS, 2. Transparent Formulation for Adhesives", (Aug. 2002) Kaneka, Belgium.

* cited by examiner

*Primary Examiner*—Bernard Lipman
(74) *Attorney, Agent, or Firm*—Hunton & Williams LLP

(57) ABSTRACT

The present invention involves a process for caulking a ship deck includes the steps of bonding planks of tropical wood on the subdeck of said ship, sealing said planks through the application of a moisture curable sealing composition, and allowing said composition to cure during an effective period of time, characterized in that said moisture curable sealing composition comprises one or more silyl-modified polyacrylate(s).

38 Claims, 2 Drawing Sheets

METHOD FOR CAULKING THE DECK OF SHIPS

BACKGROUND OF THE INVENTION (i) Field of the Invention

The present invention relates to the field of ship and yacht building. Its subject matter is more particularly a method for caulking the deck of ships.

(ii) Description of the Related Art

It has long been known in the art of shipbuilding to use tropical wood species, such as teak, for their extraordinary resistance to wind and weather. Teak, for example, guarantees anti slip properties of the deck of the ship under dry as well as wet conditions. It also provides a protection of the subdeck underneath against weather influences, resulting therefore in a durable deck surface. Further for yacht building, tropical wood species (such as teak) used to cover the deck, are particularly appreciated by the yacht owners for their nice golden-brown colour which appears from light to dark tones.

Construction of a teak deck first requires the bonding of teak boards (also called planks, or strokes or lathes) on the substrate (or ship subdeck) which may be made of a metal (for instance aluminium), of a metallic alloy (such as steel or painted steel), of a material comprising polyester (such as reinforced polyester) or wood (such as plywood). These teak planks may have for instance a parallelepipedic shape, with a length comprised between 10 cm to 5 meters, a width comprised between 3 to 20 cm, and a thickness comprised between 4 mm to 4 cm. By the term "teak plank", it is also intended to include plywood on which a layer of teak of a few millimetres thick is applied. Teak planks may also be available under various other shapes, depending on the particular geometry of the part of the ship deck. They are generally supplied in different cross-section types, such as a rectangular cross-section, or with a T-profile or a L-profile.

After bonding the teak planks on the subdeck, there remains, between adjacent planks, an empty interspace (also called a seam), which has substantially the shape of a ribbon with a width comprised between 3 to 20 mm (preferably between 5 to 10 mm) and with a depth comprised between 6 to 10 mm. The seam is most of the time a straight ribbon parallel to each side of the rectangular teak planks. In the case of teak planks having a shape other than parallelepipedic, the seam follows the perimeter of such planks, not being necessarily a straight ribbon.

The caulking process comprises sealing (or jointing) the bonded teak planks by filling the seams around them through the application of a sealing composition, for instance a moisture curable sealing composition, in order to obtain, after curing, a joint which prevents dust, dirt, moisture, chemicals or sea water from penetrating into the seam and from being in contact with the subdeck, in order to prevent possible damage or corrosion of the ship deck or subdeck.

The cured sealing composition should possess a hardness appropriate for its use as a joint for of a ship deck.

The cured sealing composition should also confer some movement capability to the joint, resulting in its ability to keep its protective function in case of relative movements of the teak planks, such as shrinking and expanding, due to the changing thermal and environmental conditions. Such ability is linked to some elastic (or rubber-like) behaviour of the cured composition, expressing itself in appropriate tensile stress/strain properties.

Further, it is required of the cured sealing composition that during the relative movements of the teak planks hereinabove mentioned, cohesion of the joint is maintained together with its adhesion to the sides of the teak planks, within the seam. Therefore an appropriate balance of adhesion and cohesion is also required.

This sealing composition (or sealant) is usually applied into the seam directly from its container, namely a cartridge or a flexible package (also called a sausage) whose nozzle has been cut to correspond to the width of the seam. A rope of the sealing composition is so applied within the seam, with a 10% to 20% weight surplus, which is pressed into the seam with a spatula. The ability of the sealing composition to be delivered from the cartridge or sausage in which it is contained, and to fill the seam is reflected in particular by appropriate rheological properties (viscosity).

Immediately after applying the moisture curable sealing composition, a spatula is used to press it into the seams, and to remove excess of it. This operation leaves a thin layer of the moisture curable sealing composition on the surface of the adjacent planks, on either side of the seams. Then the deck is allowed to stay during a certain period of time, depending upon the temperature and relative humidity (usually between 4 to 7 days), so that the moisture curable sealing composition is sufficiently cured.

Thereafter, the ship deck is generally sanded in order to obtain the desired aesthetic appearance of the teak planks, and also to eliminate the part of the cured sealing composition still present as a thin layer on the surface of the adjacent planks, on either side of the seams. Hardness of the sealed composition must be such that the joint is not altered by the carefully carried out sanding operation.

Commercial moisture curable sealing compositions intended for use for deck caulking are known. In particular a moisture curable sealing composition comprising a silyl-modified polyether, more precisely a silyl-modified polypropylene oxide wherein the polypropylene oxide main chain is linked at each of its both ends to a $—Si(CH_3)(OCH_3)_2$ group through a $—CH_2—CH_2$-radical, is marketed by the company Bostik under the name of SIMSON® MSR DC. The silyl-modified polyether polymer comprised in this composition is for instance marketed under the name MS-Polymer® by the Kaneka company. During curing of said moisture curable sealing composition, the silicon-containing end-groups are capable of hydrolysing in the presence of the air moisture and under the influence of a catalyst, to form siloxane linkages. The resulting cured composition possesses the properties required for a teak plank joint.

There is a need however to improve the properties of existing sealing compositions intended for use for deck caulking, in particular with respect to chemical and weathering resistance.

With respect to chemical resistance, there is a growing trend from yacht owners to frequently use cleaning solutions (or brighteners) comprising various chemicals selected from organic or inorganic compounds, with an acidic, neutral, or alkaline nature, in order to clean the teak decks of their yachts and maintain the aesthetic appeal of teak. After long periods of time, as the ship becomes older, there is the problem that the exposure of the ship deck to sea-water, to changing temperature conditions, and to extended exposure to UV-light, in combination with the frequent application of the cleaning solutions on the teak deck, may result in the joint becoming sticky or tacky. In the worst case, the sealant can show staining effects.

In some cases, the cured sealing composition may lose adhesion from the sides of the seams surrounding the teak planks, with the adverse consequence that the subdeck may be in contact with the sea water, resulting in a risk of damage and corrosion of the deck itself or the subdeck.

SUMMARY OF THE INVENTION

The present invention provides in particular a new and improved method for deck caulking.

The present invention provides a process for caulking a ship deck, which comprises:

a) bonding planks of tropical wood on the subdeck of said ship, b) sealing said planks through the application of a moisture curable sealing composition, then c) allowing said composition to cure during an effective period of time, characterized in that said moisture curable sealing composition comprises one or more silyl-modified polyacrylate(s).

It has been found that said moisture curable sealing composition may be conveniently implemented as a seam sealer (or caulker), in particular thanks to an appropriate viscosity. Further, the resulting cured composition possesses hardness, tensile stress/strain properties, and a balance of adhesion and cohesion which are acceptable for a joint surrounding the planks of the ship deck. At the same time, this method provides a joint which shows an improved resistance in time to the combined action of cleaning solutions and exposure to sea water, elevated temperatures and UV-light.

According to a preferred embodiment, the silyl-modified polyacrylate which is implemented in the present invention comprises an acrylate main chain linked directly or indirectly to a crosslinkable silyl group at each of its both ends (or terminal positions), and exhibits a polydispersity index of less or equal than 1.8.

The main chain of the polyacrylate is obtainable by polymerizing one or more monomer(s) consisting of a compound of formula:

$$CH_2{=}CH{-}CO{-}OR^1 \qquad (I)$$

wherein $R^1$ is an alkyl or alkoxy radical comprising from 1 to 12 carbon atoms, preferably from 2 to 5 carbon atoms.

Among the specific monomers which can be used to obtain the main chain of the polymer implemented in the method according to the invention, there may be cited the following ones : methyl acrylate, ethyl acrylate, n-propyl acrylate, isopropyl acrylate, n-butyl acrylate, isobutyl acrylate, tert-butyl acrylate, n-pentyl acrylate, n-hexyl acrylate, cyclohexyl acrylate, n-heptyl acrylate, n-octyl acrylate, 2-ethylhexyl acrylate, nonyl acrylate, decyl acrylate, dodecyl acrylate, 2-methoxyethyl acrylate, 3-methoxybutyl acrylate.

Preferred monomers are selected among ethyl acrylate, n-butyl acrylate, 2-methoxyethyl acrylate.

The crosslinkable silyl group may be represented by the general formula:

$$-[Si(R^2)_{2-b}(Y)_bO]_m-Si(R^3)_{3-a}(Y)_a \qquad (II)$$

wherein:

$R^2$ and $R^3$ are the same or different and each represents an alkyl group containing 1 to 20 carbon atoms, an aryl group containing 6 to 20 carbon atoms, an aralkyl group containing 7 to 20 carbon atoms or a triorganosiloxy group represented by $(R')_3SiO$— (in which R' is a univalent hydrocarbon group containing 1 to 20 carbon atoms and the three R' groups may be the same or different) and, when there are two or more $R^2$ or $R^3$ groups, they may be the same or different;

Y represents a hydroxyl group or a hydrolyzable group and, when there are two or more Y groups, they may be the same or different;

a represents 0, 1, 2 or 3, b represents 0, 1 or 2 and m is an integer comprised between 0 and 19, provided that a+mb is greater or equal than 1.

According to a preferred embodiment, m equals 0 in the general formula (II).

According to a more preferred embodiment, the crosslinkable silyl group of formula (II) is selected among: $-Si(OCH_3)_3$, $-Si(CH_3)(OCH_3)_2$, $-Si(OCH_2CH_3)_3$, $-Si(CH_3)(OCH_2CH_3)_2$.

The crosslinkable silyl group, in particular of formula (II), may be linked to the main acrylate chain of the polymer through a divalent hydrocarbon radical such as : $-CH_2-CH_2-$.

The polydispersity index of the polymer is defined as the ratio of the weight average molecular weight $M_w$ to the number average molecular weight $M_n$.

According to a preferred embodiment, the polydispersity index of the silyl-modified polyacrylate is less than or equal to 1.6, preferably less than or equal to 1.4.

A process for preparing such a silyl-modified acrylic polymer is described hereafter.

In a first step, an atom transfer radical polymerization process is advantageously carried out, comprising polymerizing the one or more monomer(s) using as an initiator an organic halide or halogenated sulfonyl compound having two or more initiation sites, in presence of a transition metal complex as the polymerization catalyst.

Among such initiators, mention may be made of the following compound of formula (III):

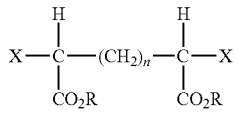

wherein:

X is a chlorine, bromine or iodine atom,

R is an alkyl or alkoxy radical comprising from 1 to 12 carbon atoms, and n is an integer of 0 to 20, preferably from 2 to 10.

A preferred initiator is diethyl 2,5-dibromoadipate, namely the compound of formula (III) above wherein X is bromine, R is ethyl, n is 2.

The transition metal complex to be used as the polymerization catalyst is a metal complex containing, as a central atom, an element belonging to the group 7, 8, 9, 10 or 11 of the periodic table. More preferred are complexes of copper, nickel, ruthenium and iron, and particularly preferred are zero-valent copper, univalent copper, bivalent nickel, bivalent ruthenium or bivalent iron. Copper complexes are preferred among others. Specific examples of the univalent copper compound are cuprous chloride, cuprous bromide, cuprous iodide, cuprous cyanide, cuprous oxide and cuprous perchlorate. When such a copper compound is used, a ligand such as 2,2'-bipyridyl or a derivative thereof, 1,10-phenanthroline or a derivative thereof or a polyamine such as tetramethylethylenediamine, pentamethyldiethylenetriamine or hexamethyltris (2-aminoethyl) amine is added for increasing the catalytic activity.

The atom transfer radical polymerization process is advantageously carried out using as a catalyst a combination of cuprous bromide and pentamethyldiethylenetriamine.

This polymerization process can be carried out in the presence of various solvents hydrocarbon solvents such as benzene and toluene, ether solvents such as diethyl ether and tetrahydrofuran, halogenated hydrocarbon solvents such as methylene chloride and chloroform, ketone solvents such as acetone, methyl ethyl ketone and methyl isobutyl ketone, alcohol solvents such as methanol, ethanol, propanol, isopropanol, n-butyl alcohol and tert-butyl alcohol, nitrile solvents such as acetonitrile, propionitrile and benzonitrile, ester solvents such as ethyl acetate and butyl acetate, carbonate solvents such as ethylene carbonate and propylene carbonate, and the like. These may be used singly or two or more of them may be used in a mixture. Preferred solvent is acetonitrile.

The polymerization can be carried out within the temperature range of 50 to 150° C., preferably at about 70° C.

In a second step, at the final stage of the polymerisation or after completion of the reaction of the monomer(s) as here above described, there is introduced into the reaction medium a compound having at least two low polymerizability alkenyl groups, for example 1,5hexadiene, 1,7-octadiene or 1,9-decadiene. Following this introduction, and after appropriate treatment, there is obtained an acrylic polymer chain having at its both ends, in other terms in the two terminal positions of the chain, a vinyl group : —CH=$CH_2$.

In a third step, a crosslinkable silyl group-containing hydrosilane or hydrosiloxane compound of formula:

$$H—[Si(R^2)_{2-b}(Y)_bO]_m—Si(R^3)_{3-a}(Y)_a \quad (IV)$$

wherein $R^2$, $R^3$, Y, m, a and b are as defined above, is added to the acrylic polymer previously obtained, in presence of a transition metal as a catalyst.

The transition metal catalyst includes, among others, simple substance platinum, solid platinum dispersed in/on a carrier such as alumina, silica or carbon black, chloroplatinic acid, chloroplatinic acid complexes with alcohols, aldehydes, ketones or the like, platinum-olefin complexes, and platinum (0)—divinyltetramethyldisiloxane complex, said complex being particularly preferred as the transition metal catalyst to be used.

For other manufacturing methods and other details regarding the silyl-modified polyacrylate(s) to be used in the method according to the invention, one may address EP 1 371 670, which is incorporated herein by reference.

The silyl-modified polyacrylate(s) may suitably be present in the sealing composition applied in the process according to the invention, in an amount comprised between 20% and 80%, preferably between 40 and 60% based on the total weight of the sealing composition. All percentages in the present text are percentages expressed in weight, except otherwise indicated. All percentages relating to the ingredients of the sealing composition are also expressed on the basis of the total weight of said composition The sealing composition also comprises a catalyst which has activity for the cross-linking of the crosslinkable silyl group of the silyl-modified polyacrylate(s). Mention may be made among such catalyst of organotin catalysts, such as dibutylbis (2,4-pentanedionato-O,O') tin (DBTDAA), or dibutyltindilarauate (DBTDL), dibutyltindiacetate, dibutyltindibutylate, tinoctoate or combinations of tin octoate and laurylamine (co-catalyst system). Alternatively, orthotitanates and other organic titanates (titanium chelates) such as titanium acetylacetonate, diisopropoxy-titanium-bis(ethylaceto-acetate), dibutoxy-titanium-bis(ethylaceto-acetate), dibutoxy-titanium-bis-acetylacetonate may be used. A suitable quantity of catalyst, preferably Tin(IV)-catalyst, may be between 0.1 to 1%, preferably between 0.2 and 0.9%.

The sealing composition also comprises one or more fillers selected among a broad range of fillers, especially calcium carbonate, preferably calcium stearate-coated, precipitated calcium carbonate and grounded stearate coated calcium carbonate. The filler(s) may be present in an amount comprised between 20 and 60%, preferably between 35 and 55%.

The sealing composition also comprises one or more organofunctional alkoxysilanes, such as trialkoxysilanes (especially trimethoxysilanes), and/or amino-, mercapto- or epoxy-containing alkoxysilanes. These compounds act as water scavengers, (especially the vinyltrimethoxysilane, vinylmethyldimethoxysilane, methyltrimethoxysilane) which means that they have the function of controlling the moisture content in the composition, in order to prevent immediate cross-linking of the silyl-modified polyacrylate, resulting in increased viscosity or even solidification of the composition in its commercial container, during storage. Moisture may be even imported into the sealing composition by some of its ingredients such as the fillers or the pigments. It is also believed that alkoxysilanes act as adhesion promoter. A suitable quantity of these compounds in the sealing composition may be about 1 to 10%, preferably 2 to 8%.

The sealing composition also comprises other additives which include one or more pigments, one or more heat/UV-stabiliser(s), and antioxidants. The pigments may comprise carbon black or inorganic pigments such as iron oxide. The UV stabiliser may be selected from the hindered amine light stabilisers, (such as for example the products available under the Trade Name Tinuvin 770 available from the company Ciba SC), from the benzotriazoles or the benzophenones for example the product available under the Trade Name Tinuvin 327 or Tinuvin 328. A suitable antioxidant may also be selected from, for example, the products available under the trade name Irganox 1010, 1035 or 1076, from the company Ciba SC. Amount of the other additives used is generally between 0.5 to 8%, preferably between 1 to 3%.

At last, the sealing (or sealant) composition may also comprise one or more plasticizer(s). The plasticizer may be selected among phthalate esters such as dibutyl phthalate, aliphatic esters such as butyl oleate, acrylic derivatives such as the UP-series products commercialized by the company Toagosei Co., Ltd. A suitable quantity of the plasticizer may be about 0 to 30%, preferably 0 to 10%.

The sealant composition may be prepared by combining the silyl-modified polyacrylate, the pigment(s), UV-stabilizer(s), plasticizer(s) and the filler(s) under low speed mixing followed by a high speed mixing under vacuum to increase the temperature to at least 40° C. and/or, preferably not more than 45° C. The alkoxysilane (water scavenger) is usually introduced into this heated mix under vacuum followed by mixing. Generally, the adhesion promoter, then the catalyst are added under vacuum followed by mixing.

After its preparation, the sealing composition is generally packed in an impermeable (air-tight) container to protect it from ambient moisture, preferably after a balanced heat-treatment to encourage the scavenging of moisture from the composition. One suitable impermeable material for the container is high density polyethylene or polyethylene coated with aluminium foil. The container is suitably in the form of a cartridge or respectively in the form of the sausage suitable for use in conjunction with application equipment.

The sealing (or sealant) composition which has been described hereinbefore results after its application in the seams around the teak planks, and after curing, in a joint of a nice black color, which exhibits an improved durability in time, including a substantially unchanged color, despite various weather conditions, cleaning operations and exposure to direct sunlight (UV-light).

BRIEF DESCRIPTION OF THE DRAWINGS

Other features and preferred embodiments of the method according to the invention are now described in reference to the enclosed drawings, showing.

DETAILED DESCRIPTION OF PREFERRED EMBODIMENTS

The caulking process according to the present invention is useful for treating the whole or a part of a ship deck. When the caulking process concerns only a part of the deck, it can be also implemented to repair or change an old part of a deck, which for instance has been damaged.

Figure 1:
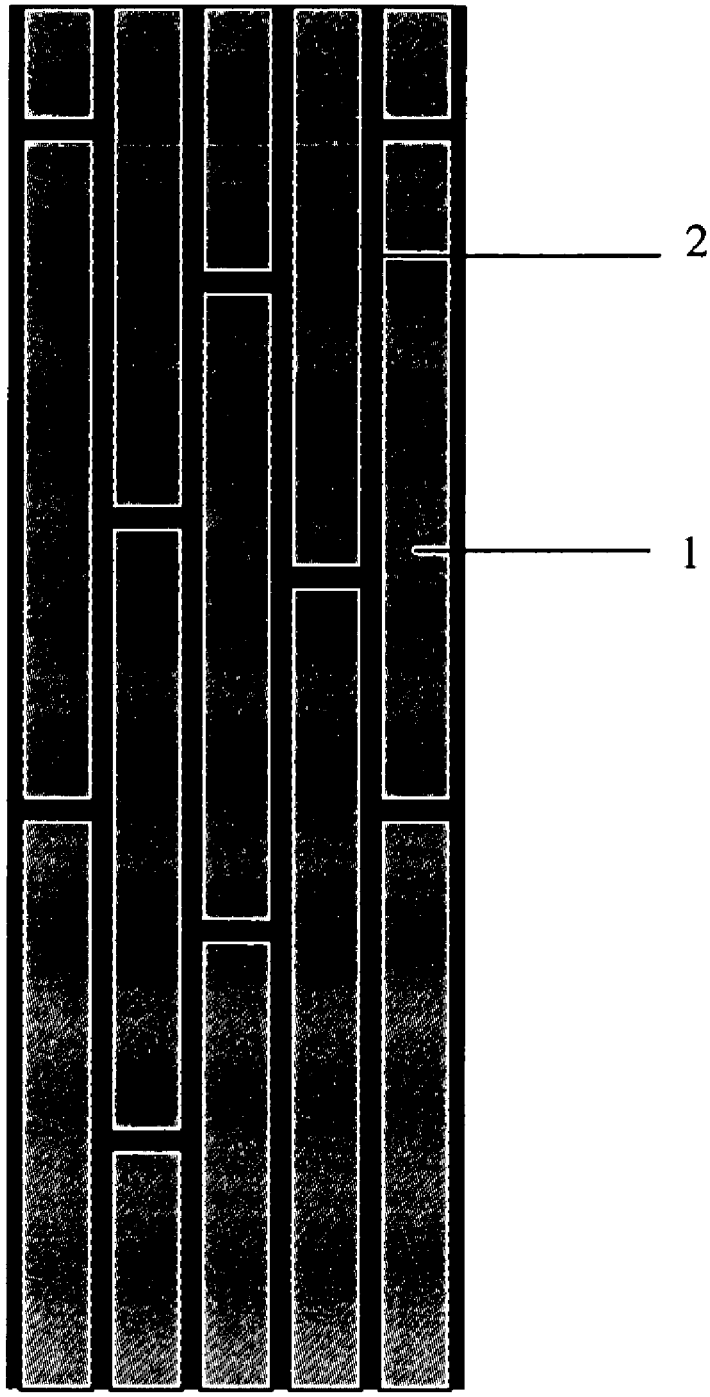
FIG. 1: a view from the top of a part of a caulked ship deck

FIG. 1 shows a part of a caulked ship deck comprising planks 1 of a tropical wood, sealed by a joint 2 obtained by the curing of the moisture curable composition described herein before.

Figure 2:
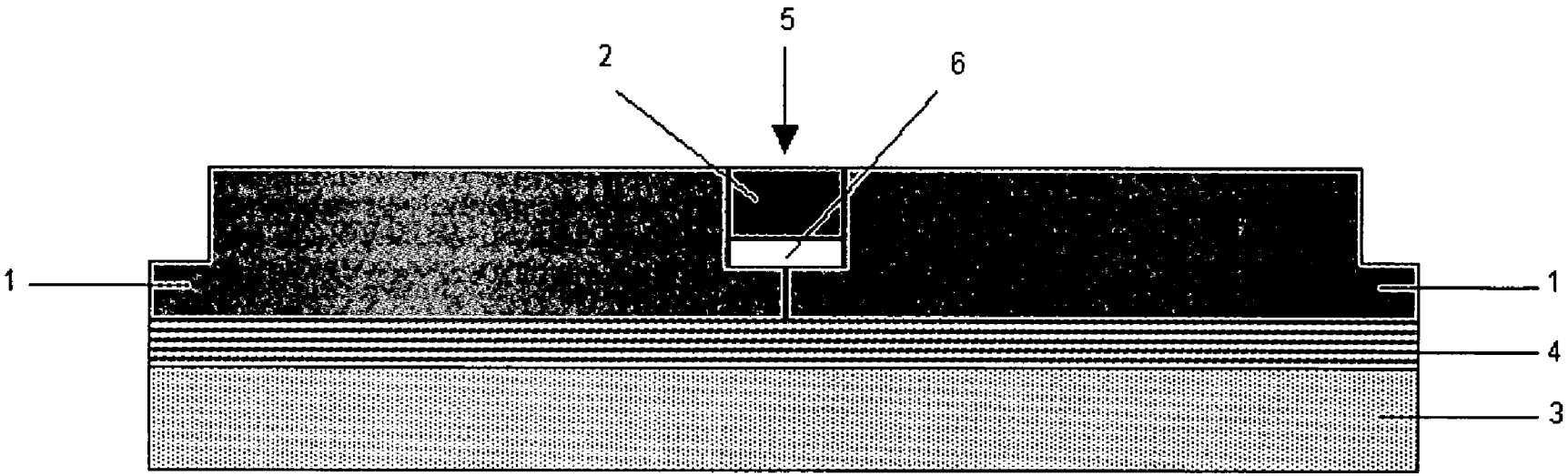
FIG. 2: a cross-section of a part of a caulked ship deck limited to 2 adjacent planks.

According to a preferred embodiment, described in reference to FIG. 2, the planks of tropical wood 1 are bonded to the subdeck 3 of the ship using a moisture curable sealing composition comprising MS-Polymer®, such as SIMSON® MSR BC (for Bedding Compound) commercialized by Bostik. After curing, this bonding results in a layer 4 whose thickness may very from 0.1 to 3 mm, preferably from 0.5 to 2 mm, which adheres to the subdeck 3 and to the bottom surface of the planks 1. Before bonding the planks to the subdeck, the surfaces of the corresponding substrates may be treated with an appropriate primer, in order to improve adhesion.

According to an other embodiment, also described in reference to FIG. 2, the planks 1 of tropical wood have a profile of a T-type, resulting in the seam 5 presenting a substantially rectangular cross-section, whose height is less than the total thickness of the planks.

The sealing operation described in step b) of the process according to the invention is conveniently implemented by filling the seams (between adjacent planks bonded to the subdeck) with the moisure curable sealing composition. Before filling the seams, the sides thereof may be advantageously treated with an appropriate primer, in order to improve adhesion.

The quantity of silyl-modified polyacrylate to be applied by means of the moisture curable sealing composition, for sealing the planks may vary largely depending on various parameters, such as the width of the seams, the geometry of the deck, the depth of the seams and their particular profile. Generally this quantity is comprised between 280 and 1400 g/m$^2$, preferably between 600 and 1000 g/m$^2$, expressed on the basis of the total surface of deck to be caulked.

According to a further embodiment, also described in reference to FIG. 2, which may be taken in combination with the preceding ones, before filling the seams with the moisture curable sealing composition described here above, a tape 6 is laid upon the bottom side of the seam. Such a tape, which may consist of polyethylene, and have a width corresponding to the width of the seam is also called a bond breaker tape. It is thought, by preventing adhesion of the joint on the bottom side of the seam, to help the joint accommodate the movements of the teak deck, due for instance to shrinkage and expansion under the changing environmental conditions.

During the bonding of the planks and during the sealing operation, the temperature should be between 5 and 35° C., and relative humidity between 40% and 75%.

The period of time required to achieve complete curing of the sealing composition may vary according to relative humidity, temperature, water content of the planks but generally is comprised between 2 days and 2 weeks, preferably between 3 and 7 days.

According to the preferred embodiment represented on FIG. 2, after filling the seam 5 with the moisture curable sealing composition, complete curing results in the joint 2.

According to another preferred embodiment, the tropical wood used for the planks is teak, which is particularly appreciated for its durable properties and aesthetic appearance.

The present invention also relates to a ship deck comprising planks of exotic wood species, characterized in that said planks are sealed by means of a cured composition obtainable by curing the moisture curable composition such as defined in the method according to the invention.

The present invention will now be further illustrated by the following, non limiting examples.

COMPARATIVE EXAMPLE

Application of a silyl-modified Polypropylene Oxide on a Sample Teak Deck by Means of SIMSON® MSR DC Moisture Curable Composition A sample teak deck is prepared by bonding six teak planks (160 mm long and 48 mm wide) on a rectangular plywood substrate of 16 cm by about 30 cm. Bonding is made using a MS-Polymer® based commercial product available from Bostik under the name SIMSON® MSR BC. Teak planks have a total thickness of 12 mm and a cross-section of a T-type. The resulting sample comprises five seams between the adjacent teak planks. The cross section of the seams is a rectangle a width of 7 mm and a height of 6 mm.

The seams are primered by application with a paint brush of an organic solution comprising for example a silane derivative (comprising epoxy and alkoxy groups) and an isocyanate derivative. This organic solution is available from Bostik under the name SIMSON® Primer P. The application of this solution within the seams is thought to create, after drying, a thin film adhering to the 3 sides of the seam.

A bond breaking tape (about 7 mm wide) consisting of polyethylene is applied on the bottom side of the seam.

Then SIMSON® MSR DC is applied by filling the seam, and is levelled. The quantity applied corresponds to a quantity of silyl-modified polypropylene oxide of about 570 g/m$^2$.

The teak deck sample is then allowed to stay in a climatized room at 23° C. and 50% relative humidity during 2 weeks, to ensure full curing of the moisture curable composition.

Viscosity of the SIMSON® D MSR DC Moisture Curable Composition:

Viscosity was measured on rheometer Physica MCR-300 for various shear rates. The results are indicated in Table 2.

Hardness of the Joint Obtained After Curing of SIMSON® MSR DC:

Hardness was assessed according to the Shore A hardness test (described in International Standard ISO 868) which involves the measurement of the penetration of a specified pin forced in the material under specified conditions. The results are indicated in Table 2.

Tensile stress/Strain Properties of the Joint Obtained After Curing of SIMSON® MSR DC:

Tensile stress/strain properties were determined according to International Standard ISO 37, using a standard test piece of the cured composition, in the shape of a dumb-bell. Said dumb-bell is stretched until breakage in a tensile-testing machine at a constant rate of pulling of the driven grip. The results are indicated in Table 2.

Balance of Adhesion and Cohesion of the Cured Composition Resulting from SIMSON® MSR DC, Jointing the Teak Planks:

Test specimens are prepared in which the cured composition adheres to two parallel substrates of teakwood. The test specimens have an H-shape and the dimensions described in FIG. 1 of International Standard ISO 11600. The 2 teakwood substrates are pretreated with SIMSON® Primer P, then after drying/curing of the primer, the space between them is filled with the moisture curable composition. The test specimens are allowed to stay during 4 weeks at 23° C. and in an atmosphere with 50% relative humidity, for curing.

The test specimens are then submitted to tensile test, by drawing apart the 2 teakwood substrates in a Zwick 1445 tensile tester, at a speed of 6 mm/minute. The results are summarized in Table 2, and are the average of 5 repetitions.

Resistance in Time of Sample Teak Deck Caulked with SIMSON® MSR DC Under Various Temperature Conditions to the Combined Action of Cleaning Solutions and Exposure to Sea Water and UV-light:

This resistance is assessed by submitting the caulked sample teak deck to the UV/cleaner/salted water cycle.

This cycle is based on the following one-week cycle:

1 day in salted water (33 g/l of NaCl) at room temperature, followed by rinsing with tap water;

2 days in a Quick UV cycle consisting of alternating steps of 4 hours of UV-radiation at 60° C., and 4 hours at 50° C. (without UV radiation) and 100% of relative humidity;

1 day of immersion in a cleaner solution at room temperature followed by rinsing with tap water;

3 days in the same Quick UV cycle as described here above.

This basic one-week cycle is repeated several times, assessing the results after every week.

The test is carried out for a caulked sample teak deck wherein the cleaner solution is a neutral aqueous solution (pH=8.1) containing no acid, no alkaline nor abrasives (obtained from AWL Wash supplied by the company U.S. Paint).

It is also carried out for a caulked sample teak deck wherein the cleaner solution is an aqueous alkaline solution (pH=13.5), comprising a mixture of sodium hydroxide and potassium hydroxide (obtained from Teak Cleaner Part 1 supplied by the company Semco).

It is also carried out for a caulked sample teak deck wherein the cleaner solution is an acidic aqueous solution(pH=2.9), comprising phosphoric acid (obtained from Teak Cleaner Part 2 supplied by the company Semco).

It is checked whether the joints stain a paper tissue which is wiped on the surface of a sample teak deck, one time from left to right.

Right from one week, (black) stains appear on the paper tissue used to wipe the 3 samples of caulked teak deck treated respectively with a neutral, alkaline and acidic cleaner solution.

EXAMPLE 1

Application of a Silyl-modified Polyacrylate A on a Sample Teak Deck by Means of a Composition 1

A moisture curable sealing composition 1 is prepared from a silyl-modified polyacrylate A.

The main chain of polymer A is obtained by polymerizing n-butyl acrylate, and is linked at its both ends to a —Si $(OCH_3)_2(CH_3)$ silyl group, through the divalent radical —$CH_2$—$CH_2$—. The polydispersity index of A is 1.3. The number average molecular weight is 24 200 g/mol. Such a polymer is available from Kaneka corporation under the name XMAP SA 100 S.

Polymer A is mixed under low speed with carbon black as the pigment, a UV-stabilizer, and a mixture of a calcium stearate coated precipitated calcium carbonate with a ground stearate coated calcium carbonate, as the filler. This low speed mixing is followed by a high speed mixing under vacuum. The final temperature is between 40 and 45° C. A mixture of trimethoxysilane derivatives is then introduced into this heated mix under vacuum, followed by mixing. Then a tin catalyst is added under vacuum, followed by mixing.

The percentages of the ingredients of composition 1 are given in table 1.

The composition so formed is packed into a water-impermeable cartridge and sealed therein.

A sample of a caulked teak deck is prepared as described in Reference example, except that SIMSON® MSR DC is replaced by Composition 1. The quantity of polymer A applied is about 680 g/$m^2$.

Viscosity was measured on composition 1 after its manufacturing, on rheometer Physica MCR-300 for various shear rates. The results are indicated in Table 2.

The hardness, the tensile stress/strain properties and the balance of adhesion and cohesion of the cured composition obtained from composition 1 were assessed using the same tests as described previously in the Reference example.

The results are indicated in Table 2.

The resistance in time of sample teak deck caulked with composition 1 under various temperature conditions to the combined action of cleaning solutions and exposure to sea water and UV-light was assessed by the same UV/cleaner/salted water cycle as for Reference example.

Even after 4 weeks of repetition of the one-week cycle, no stain could be observed on the paper tissue used to wipe the 3 samples of caulked teak deck which had been immersed, respectively, in the neutral, alkaline and acidic cleaner solution.

EXAMPLE 2

Application of a Silyl-modified Polyacrylate A on a Sample Teak Deck by Means of a Composition 2

Example 1 is repeated by preparing and packing composition 2 as described in example 1, except that a plasticizer was mixed with Polymer A, carbon black, UV-stabilizers, filler, alkoxy silane derivatives and Tin (IV) catalyst.

The percentages of the ingredients of composition 2 are given in table 1.

The same tests were carried out: the results are indicated in Table 2.

The test based on the UV/cleaner/salted water cycle was also repeated and gave the same results as in example 1.

TABLE 1

| Ingredient | Composition 1 (in %) | Composition 2 (in %) |
|---|---|---|
| Polymer A | 56 | 51 |
| Trimethoxysilane derivatives mixture | 3.4 | 3 |
| Tin catalyst | 0.5 | 0.5 |
| Filler | 38.2 | 38.6 |
| Other additives (carbon black, UV-stabilizers) | 1.9 | 1.9 |
| Plasticizer | | 5 |

TABLE 2

| | | Composition 1 | Composition 2 | Reference |
|---|---|---|---|---|
| Viscosity (Pa · s) | Shear rate of 0.1 $s^{-1}$ | 1074 | 1032 | 1194 |
| | Shear rate of 1 $s^{-1}$ | 571 | 450 | 236 |
| | Shear rate of 2.5 $s^{-1}$ | 506 | 342 | 132 |
| | Shear rate of 5 $s^{-1}$ | 469 | 280 | 89 |
| | Shore A hardness | 35 | 35 | 41 |
| Tensile stress/strain | Tensile stress at 100% elongation (MPa) | 1.36 | 1.41 | 1.44 |
| | Tensile strength (MPa) | 1.67 | 1.61 | 2.64 |
| | Elongation at break (%) | 128 | 116 | 208 |
| Balance of adhesion/cohesion | Tensile stress at 100% elongation (MPa) | — | — | 0.95 |
| | Tensile strength (MPa) | 0.72 | 0.70 | 1.40 |
| | Elongation at break (%) | 73 | 81 | 214 |
| | Failure mode | 100% cohesive for the 3 repetitions | 100% cohesive for the 3 repetitions | 100% cohesive for 1 repetition<br>90% cohesive for 1 repetition<br>50% cohesive for 1 repetition |

The invention claimed is:

1. A process for caulking a ship deck, which comprises the steps of:

a) bonding planks of tropical wood on the subdeck of said ship, b) applying as caulking a moisture curable sealing composition comprising one or more silyl-modified polyacrylate(s) to the planks to seal said planks, and c) allowing said composition to cure for an effective period of time.

2. A process according to claim 1, wherein the silyl-modified polyacrylate comprises an acrylate main chain linked directly or indirectly to a crosslinkable silyl group at each of its both ends, and exhibits a polydispersity index of less than or equal to 1.8.

3. A process according to claim 2, wherein the main chain of the polyacrylate comprising one or more monomer units of formula:

$$CH_2{=}CH{-}CO{-}OR^1 \quad (I)$$

wherein $R^1$ is an alkyl or alkoxy radical comprising from 1 to 12 carbon atoms.

4. A process according to claim 3, wherein at least one monomer is ethyl acrylate, n-butyl acrylate, or 2-methoxyethyl acrylate.

5. A process according to claim 2, wherein the crosslinkable silyl group may be represented by the general formula:

$$-[Si(R^2)_{2-b}(Y)_bO]_m-Si(R^3)_{3-a}(Y)_a \quad (II)$$

wherein:

$R^2$ and $R^3$ are the same or different and each represents an alkyl group containing 1 to 20 carbon atoms, an aryl group containing 6 to 20 carbon atoms, an aralkyl group containing 7 to 20 carbon atoms or a triorganosiloxy group represented by $(R')_3SiO$—, wherein R' is a univalent hydrocarbon group containing 1 to 20 carbon atoms and the three R' groups may be the same or different, $R^2$ may be the same or different when there is more than one $R^2$ in the silyl group, and $R^3$ may be the same or different when there is more than one $R^3$ in the silyl group;

Y is a hydroxyl group or a hydrolyzable group, wherein Y may be the same or different where there is more than one Y in the silyl group;

a is either 0, 1, 2 or 3;

b is either 0, 1 or 2; and m is an integer from 0 to 19, with the proviso that a+mb is greater than or equal to 1.

6. A process according to claim 5, wherein m equals 0 in formula (II).

7. A process according to claim 5, wherein the crosslinkable silyl group of formula (II) is $-Si(OCH_3)_3$, $-Si(CH_3)(OCH_3)_2$, $-Si(OCH_2CH_3)_3$, or $-Si(CH_3)(OCH_2CH_3)_2$.

8. A process according to claim 2, wherein the crosslinkable silyl group is linked to the main acrylate chain through a divalent hydrocarbon radical of the formula: $-CH_2-CH_2-$.

9. A process according to claim 1, wherein the polydispersity index of the silyl-modified polyacrylate is less than or equal to 1.6.

10. A process according to claim 1, wherein the planks of tropical wood have a T-type profile.

11. A process according to claim 1, wherein 280 to 1400 grams of said moisture curable sealing composition is applied as caulking per square meter of said sub-deck.

12. A process according to claim 1, wherein the tropical wood used for the planks is teak.

13. A ship deck comprising planks of exotic wood species sealed by a cured composition obtained by curing the moisture curable composition defined in claim 1.

14. A process according to claim 3, wherein $R^1$ is an alkyl or alkoxy radical comprising from 2 to 5 carbon atoms.

15. A process according to claim 9, wherein the polydispersity index of the silyl-modified polyacrylate is less than or equal to 1.4.

16. A process according to claim 11, wherein 600 to 1000 grams of said moisture curable sealing composition is applied as caulking per square meter of said sub-deck.

17. A process according to claim 3, wherein at least one monomer is methyl acrylate, ethyl acrylate, n-propyl acrylate, isopropyl acrylate, n-butyl acrylate, isobutyl acrylate, tert-butyl acrylate, n-pentyl acrylate, n-hexyl acrylate, cyclohexyl acrylate, n-heptyl acrylate, n-octyl acrylate, 2-ethylhexyl acrylate, nonyl acrylate, decyl acrylate, dodecyl acrylate, 2-methoxyethyl acrylate, or 3-methoxybutyl acrylate.

18. A process according to claim 1, wherein the moisture curable sealing composition comprises silyl-modified polyacrylate(s) in the range of 20% to 80% based on the total weight of the moisture curable sealing composition.

19. A process according to claim 1, wherein the moisture curable sealing composition comprises silyl-modified polyacrylate(s) in the range of 40% to 60% based on the total weight of the moisture curable sealing composition.

20. A process according to claim 1, wherein the moisture curable sealing composition comprises a catalyst having activity for the crosslinking of the crosslinkable silyl group of the silyl-modified polyacrylate(s).

21. A process according to claim 1, wherein the moisture curable sealing composition comprises a filler including between 20 and 60% by weight of said moisture curable sealing composition.

22. A process according to claim 1, wherein the moisture curable sealing composition comprises a filler including between 35 and 55% by weight of said moisture curable sealing composition.

23. A process according to claim 1, wherein the moisture curable sealing composition comprises a catalyst including between 0.1 and 1% by weight of said moisture curable sealing composition.

24. A process according to claim 1, wherein the moisture curable sealing composition comprises a catalyst including between 0.2 and 0.9% by weight of said moisture curable sealing composition.

25. A process according to claim 1, wherein the moisture curable sealing composition comprises a tin(IV)-catalyst.

26. A process according to claim 1, wherein the moisture curable sealing composition comprises a tin(IV)-catalyst comprising between 0.1 and 1% by weight of said moisture curable sealing composition.

27. A process according to claim 1, wherein the moisture curable sealing composition comprises water scavengers.

28. A process according to claim 27, wherein said moisture scavengers comprise trialkoxysilanes, or amino-, mercapto- or epoxy-containing alkoxysilanes.

29. A process according to claim 27, wherein said moisture scavengers comprise trimethoxysilanes.

30. A process according to claim 1, wherein the moisture curable sealing composition comprises water scavengers including between 1% and 10% by weight of said moisture curable sealing composition.

31. A process according to claim 1, wherein the moisture curable sealing composition comprises water scavengers including between 2% and 8% by weight of said moisture curable sealing composition.

32. A process according to claim 27, wherein said moisture scavengers comprise trialkoxysilanes, or amino-, mercapto- or epoxy-containing alkoxysilanes, wherein said water scavengers comprise between 1% and 10% by weight of said moisture curable sealing composition.

33. A process according to claim 1, wherein the moisture curable sealing composition comprises heat or ultraviolet stabilizer(s), pigments, or antioxidants.

34. A process according to claim 1, wherein the moisture curable sealing composition comprises additives including heat or ultraviolet stabilizer(s), pigments, or antioxidants, and wherein said additives comprise between 0.5% and 8% by weight of said moisture curable sealing composition

35. A process according to claim 1, wherein the moisture curable sealing composition comprises additives including heat or ultraviolet stabilizer(s), pigments, or antioxidants, and wherein said additives comprise between 1% and 3% by weight of said moisture curable sealing composition.

36. A process according to claim 1, wherein the moisture curable sealing composition comprises plasticizer(s).

37. A process according to claim 1, wherein the moisture curable sealing composition comprises plasticizer(s) including between 0% and 30% by weight of said moisture curable sealing composition.

38. A process according to claim 1, wherein the moisture curable sealing composition comprises plasticizer(s) including between 0% and 10% by weight of said moisture curable sealing composition.

* * * * *